US006659154B2

(12) United States Patent
Bergeron et al.

(10) Patent No.: US 6,659,154 B2
(45) Date of Patent: Dec. 9, 2003

(54) VALANCE WITH ADJUSTABLE MOUNTING FEATURES

(75) Inventors: Bruno Bergeron, Davie, FL (US); Michael Julius Biro, Boca Raton, FL (US)

(73) Assignee: Isoteck Corporation, Pompano Beach, FL (US)

( * ) Notice: Subject to any disclaimer, the term of this patent is extended or adjusted under 35 U.S.C. 154(b) by 0 days.

(21) Appl. No.: 10/133,844

(22) Filed: Apr. 26, 2002

(65) Prior Publication Data

US 2003/0201072 A1 Oct. 30, 2003

(51) Int. Cl.[7] ..... E06B 9/00
(52) U.S. Cl. ..... 160/38; 160/178.1 V
(58) Field of Search ..... 160/38, 39, 19, 160/902, 178.1 R, 178.1 V; 248/251, 261, 262, 265

(56) References Cited

U.S. PATENT DOCUMENTS

| | | | | |
|---|---|---|---|---|
| 2,004,262 A | | 6/1935 | Widman | |
| 2,513,628 A | | 7/1950 | Eaglin | |
| 3,378,057 A | | 4/1968 | Synck | |
| 3,435,876 A | * | 4/1969 | Toti | 160/38 |
| 4,079,770 A | | 3/1978 | Woodle | |
| 4,114,233 A | * | 9/1978 | Hamilton | 160/38 X |
| 4,254,813 A | | 3/1981 | Vecchiarelli | |
| 4,384,605 A | * | 5/1983 | Schaeffer et al. | 160/38 |
| 4,662,421 A | * | 5/1987 | Basmadji et al. | 160/38 |
| 4,840,216 A | | 6/1989 | John | |
| 4,955,419 A | | 9/1990 | Morris | |
| 5,012,850 A | * | 5/1991 | Schrader | 160/38 |
| 5,039,049 A | | 8/1991 | Niemi | |
| 5,042,548 A | | 8/1991 | Attal | |
| 5,232,039 A | * | 8/1993 | Shapiro et al. | 160/38 X |
| 5,383,508 A | | 1/1995 | Pavlica et al. | |
| 5,465,516 A | | 11/1995 | Stabile | |
| 5,660,219 A | | 8/1997 | Ford et al. | |
| 6,094,796 A | | 8/2000 | Biro | |
| 6,202,967 B1 | | 3/2001 | Fraczek | |

* cited by examiner

*Primary Examiner*—David Purol
(74) *Attorney, Agent, or Firm*—Ronald V. Davidge

(57) ABSTRACT

The central elongated portion of a valance is mounted to an external surface, such as a headrail of a vertical blind assembly or a vertical wall, by a number of brackets, with the valance being attached to each bracket at a pivot point formed by a bracket tab extending into a first slot of the valance and at a latching point formed by one of a number of teeth of the bracket extending into a second slot of the valance. At each bracket, the valance can be straightened by adjusting a distance to the external surface and by adjusting a rotational angle of the bracket about the longitudinal axis of the central elongated portion of the valance.

14 Claims, 3 Drawing Sheets

VALANCE WITH ADJUSTABLE MOUNTING FEATURES

BACKGROUND OF THE INVENTION

1. Field of the Invention

This invention relates to a valance, and, more particularly, to mounting a valance in a manner providing for angular adjustment of the elongated central member of the valance about its longitudinal axis.

2. Summary of the Background Art

Valances, or cornices, have been used for many years as interior decorations covering the mechanisms for attachment and movement of window coverings, such as vertical and horizontal blinds, curtains and drapes. Such mechanisms are typically adjacent the top of a window, with the window covering handing downward from the mechanism.

A number of patents describe brackets for mounting the central elongated member of a valance to horizontal surface extending behind the valance, such as the top of a headrail of a blind assembly, with a horizontal adjustment being provided to vary the spacing between the valance and the headrail. For example, U.S. Pat. Nos. 4,079,770 and 6,094,796 describe such brackets having slots to provide such an adjustment. In the bracket of U.S. Pat. No. 4,079,770, the valance is held between a pair of forward-extending curved portions, while, in the bracket of U.S. Pat. No. 6,094,796, the valance is supported by means of a first tab extending upward into a first slot in the elongated central portion of the valance, and by means of a second tab extending downward into a second slot therein. U.S. Pat. Nos. 4,254,813 and 5,012,850 each describe a bracket including a series of holes which are individually aligned with other features to vary the horizontal distance between the valance and the headrail. In the bracket of U.S. Pat. No. 4,254,813 holes are aligned with features of a formed spring clip clamped to the headrail. Tabs extending from the spring clip are also used to fasten both the headrail and the valance to a structural surface disposed above the headrail. In the device of U.S. Pat. No. 5,012,850, a single screw is driven through a first hole in a series of holes within a spring clip engaging the headrail, and through a second hole in a series of holes in the valance mounting bracket, into a structural surface disposed above the headrail. The valance includes a leg extending rearward, between a camping surface provided by the valance mounting bracket and the structural surface. The valance can therefore be moved for adjustment, to be held in place by clamping. While such devices provide effective adjustments for the horizontal distance between the valance and the headrail, what is needed is a mounting method providing additionally for adjusting the angular positioning of the elongated central valance member along its longitudinal axis. Such an additional adjustment could be used to compensate for changes in this angular positioning due to dimensional variations of the valance mounting brackets and other structures, such as the headrail and the structural surface to which the valance and headrail are mounted.

Other patents describe methods for mounting a valance to a headrail or similar structure without providing for such an adjustment of the horizontal distance between the valance and the headrail or similar structure. For example, U.S. Pat. No. 5,042,548 describes a valance including a rearward-extending flange that engages a slot within a bracket extending forward from a headrail. U.S. Pat. No. 4,840,216 describes a valance slidably mounted to extend forward from the front surface of a headrail. U.S. Pat. No. 4,955,419 describes a folding valance that is removably mounted to the header of a horizontal blind assembly by means of a pair of hook and loop fasteners. U.S. Pat. No. 5,660,219 describes a valance having an elongated frontpiece with a backside having an opening that is fastened to a headrail by means of a fastener. U.S. Pat. No. 6,202,967 describes a valance that extends downward as a part of the headrail, which is held against upward against a structural surface by means of a bracket. Still, what is needed is a method providing for adjustments, so that the valance can be straightened to overcome dimensional variations when it is installed.

Other patents describe methods for mounting a valance or a curtain rod to a vertical wall surface while providing for an adjustment in the horizontal distance between the valance and the wall. For example, U.S. Pat. No. 3,378,057 describes a valance that is mounted by a pair of brackets extending rearward atop a pair of brackets extending forward from the wall. Elongated slots in the brackets fastened to the valance are used to provide the adjustment. U.S. Pat. No. 5,039,049 describes a rod and bracket assembly including rearward-extending end brackets that that slide along brackets extending forward from the wall, with spring members of the end brackets engaging a number of holes provided in the brackets extending outward from the wall to provide the adjustment. The rod is also centrally supported by a bracket also attached, by means of a screw adjustable within an elongated slot, to a bracket extending outward from the wall. Again, what is needed is a method allowing the valance or curtain rod to be clamped and angularly adjusted at several places along its length.

Yet other patents describe methods for mounting a valance against a wall surface without providing for an adjustment in the horizontal distanced between the wall and the valance. U.S. Pat. Nos. 2,004,262, 2,513,628 and 5,383,508 describe valances having ends that extend inward to be rigidly attached to a wall surface without provision for adjustment. U.S. Pat. No. 5,465,516 describes a valance assembly designed for removable attachment to an existing in-store display fixture by means of brackets extending rearward to engage slots within vertically extending uprights. The valance assembly can be moved upward and downward among these slots, but there is no way to adjust the distance between the valance and the uprights. Still, what is needed is a way to provide for adjusting the angular relationship between a valance and supporting brackets, so that the valance can be aligned to overcome dimensional variations.

SUMMARY OF THE INVENTION

According to a first aspect of the invention, a mounting bracket is provided for mounting a valance to an external structure. The mounting bracket includes a pivot, a number of latches, and an attachment structure. The pivot is for engaging a pivot receiving structure within the valance. The number of latches is for alternately engaging a latch receiving structure within the valance, with the number of latches being disposed in a first direction from one another and in a second direction, perpendicular to the first direction, from the pivot. The attachment structure is for attaching the mounting bracket to the external surface.

According to a second aspect of the invention, a valance assembly is provided. The valance assembly includes an elongated valance member and a number of mounting brackets for mounting the elongated valance member to an external structure. The mounting brackets are spaced apart along the elongated valance member. Each mounting bracket includes an attachment structure for attaching the mounting bracket to the external surface. The elongated valance member is mounted on each of the mounting brackets at a pivot point and at a latching point within a number of latching points. The elongated valance member is mountable on each of the mounting brackets at each latching point within the number of latching points while the elongated valance member is additionally mounted on the mounting bracket at the pivot point.

DETAILED DESCRIPTION OF THE INVENTION

Figure 1:
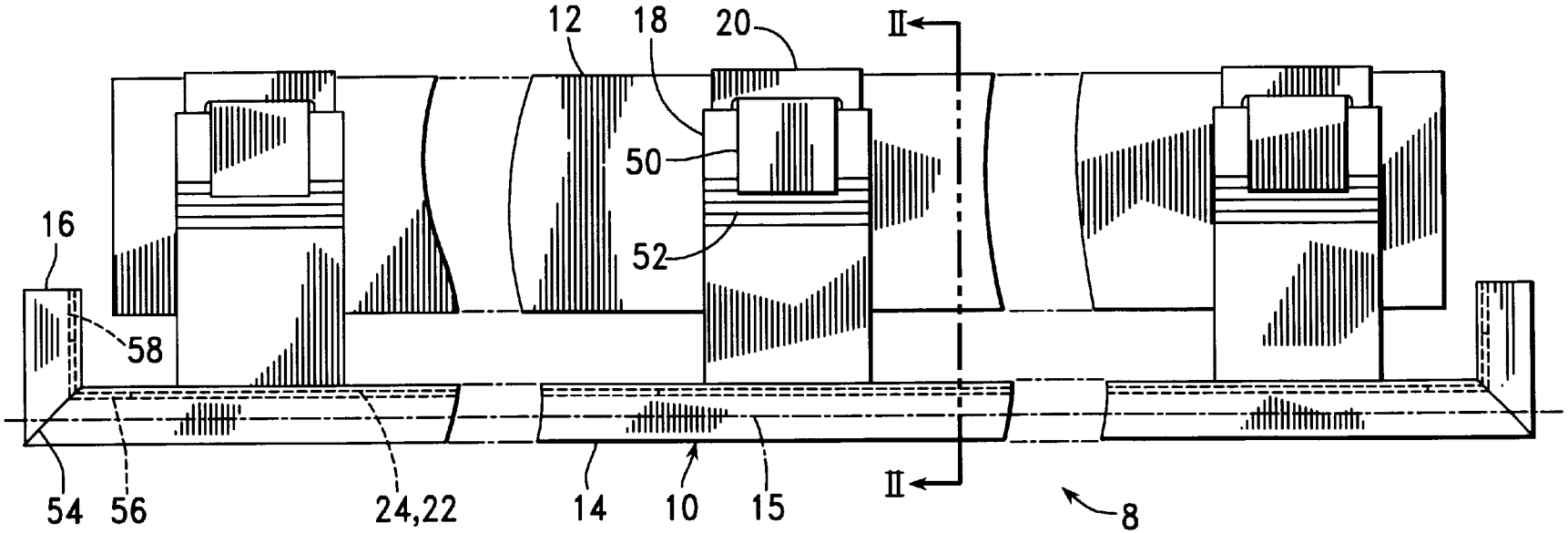
FIG. 1 is a fragmentary plan view of a valance mounted on a headrail in accordance with a first embodiment of the invention.

FIG. 1 is a fragmentary plan view of a valance assembly 8, including a valance 10 mounted on a headrail 12 in accordance with a first embodiment of the present invention. The headrail 12 is, for example, a headrail at the top of a vertical blind assembly. The valance 10 includes an elongated central portion 14, having a horizontally extending longitudinal axis 15, and a pair of inward-extending end portions 16. The valance 10 is mounted to the headrail 12 by means of a number of brackets 18, each of which is held by a mounting clip 20 attached to the headrail 12.

Figure 2:
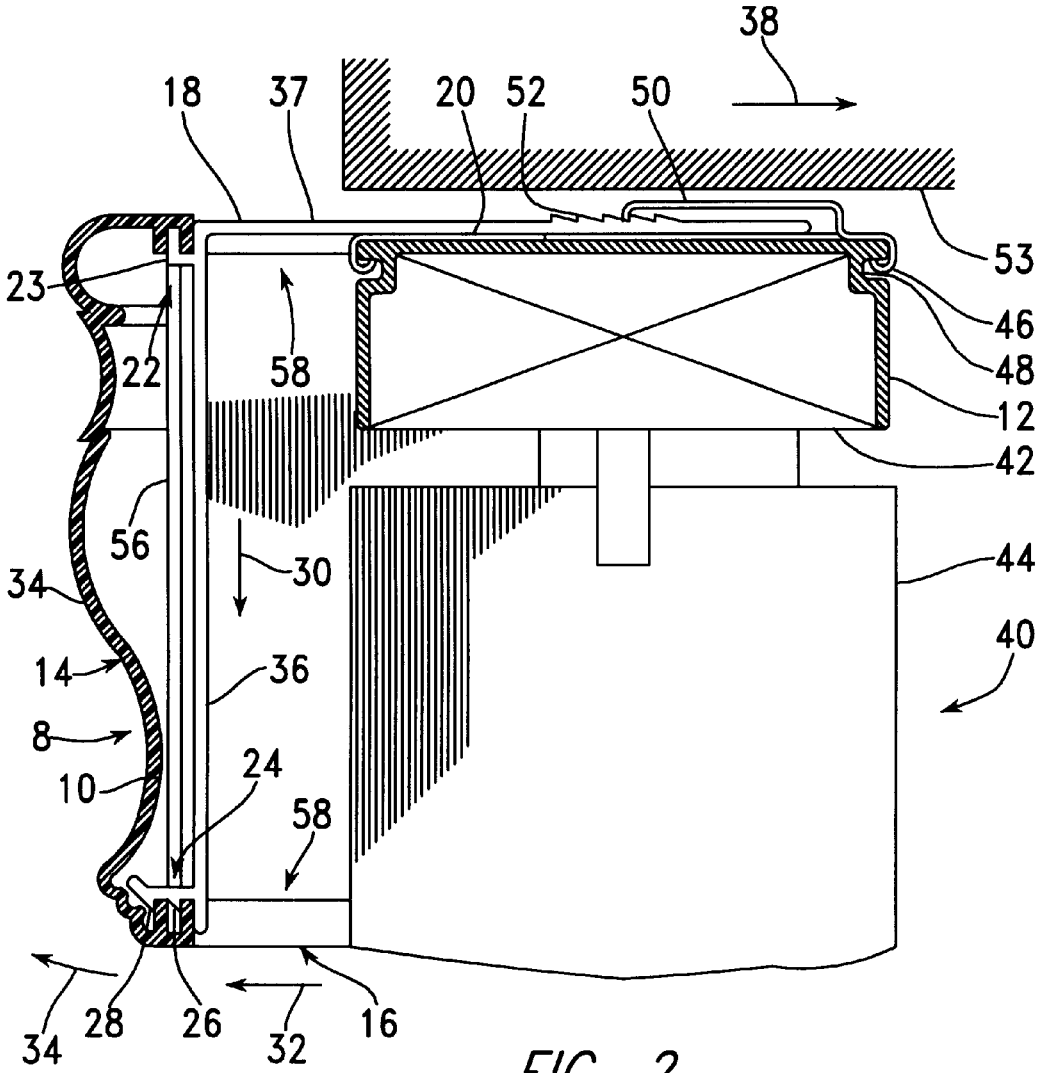
FIG. 2 is a transverse cross-sectional view of the valance and headrail of FIG. 1, taken as indicated by section lines II—II therein, with the valance retained in a first position of a mounting bracket.

FIG. 2 is a transverse cross-sectional view of the valance assembly 8, taken as indicated by section lines II—II in FIG. 1. The central elongated portion 14 of the valance 10 includes a downward-extending upper slot 22, holding an upward-extending tab 23 forming a part of the bracket 18 to establish a pivoting connection between the valance 10 and the bracket 18. The central elongated portion 14 also includes an upward-extending lower slot 24, into which a tooth 26, also forming a part of the bracket 18 extends to latch the valance 10 in place in a first location on the bracket 18.

Figure 3:
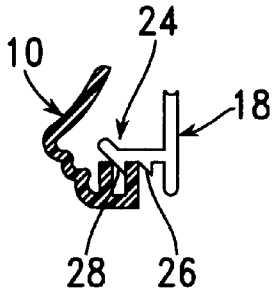
FIG. 3 is a fragmentary transverse cross-sectional view of the valance of FIG. 1, retained in a second position of the mounting bracket.

FIG. 3 is a fragmentary cross-sectional view of the valance assembly 8, also taken as indicated by section lines II—II in FIG. 1. In the example of FIG. 3, a second tooth 28, also forming part of the bracket 18 extends into the lower slot 24 to latch the valance 10 in place in a second location on the bracket 18.

Referring to FIGS. 2 and 3, the lower slot 24 is disposed downwardly, in the direction of arrow 30, from the upper slot 22, and the second tooth 28 is disposed from the first tooth 26 in the direction of arrow 32, perpendicularly to the direction of arrow 30, so that movement of the valance 10 relative to the bracket 18 between the position of FIG. 2 and the position of FIG. 3 causes the valance 10 to be pivoted in the direction of arrow 34 relative to the bracket 18 with the pivot tab 23 being retained in the upper slot 22. The central elongated portion 14 of the valance 10 includes a flexible web 34 extending between the upper slot 22 and the lower slot 24, and the bracket 18 includes a flexible web 36 extending between the pivot tab 23 and the teeth 26, 28. The flexure of these webs 34, 36 allows the teeth 26, 28 to snap into the lower slot 24 as the bracket 18 is pivoted in the direction of arrow 34 relative to the valance 10, with the pivot tab 23 being retained in the upper slot 22. The central elongated portion 14 and the bracket 18 are preferably each composed of an extruded thermoplastic resin providing such flexibility.

The bracket 18 also includes an attachment leg 37, extending rearward in the direction of arrow 38 to be attached to the headrail 12. In the example of FIG. 2, the headrail 12 forms an upper portion of a vertical blind assembly 40, in which a mechanism 42 controls the angle and spacing of a number of vertical slats 44. The attachment leg 37 is connected to the headrail 12 by means of a mounting clip 20, having a pair of lower tabs 46 held within slots 48 of the headrail 12. The mounting clip 20 also includes an upper tab 50 engaging one of a number of latching surfaces 52 extending along the attachment leg 37 of the bracket 18. The latching surfaces 52 are spaced apart in the rearward direction of arrow 38 so that the bracket 18 may be held at any of several positions separated in this direction, allowing the forward or rearward adjustment of the position of the valance 10 with respect to the headrail 12.

The vertical blind assembly 40 is typically mounted within space for a window or door in a wall, with an upper surface 53 of this space extending closely above the headrail 12, and with the headrail 12 being attached to the wall by means not shown. The apparatus of the invention thus provides for attachment of the bracket 18 within a narrow space above the headrail 12.

Referring to FIGS. 1 and 2, the end portions 16 of the valance 10 are preferably formed from an extrusion having the same shape as that of the central elongated portion 14, with the end portions 16 being joined at mitered corners 54 to ends of the central portion 14 by means of "L"-shaped brackets 56 extending within the slots 22, 24 of the central portion 14 and also within similar slots 58 of the end portions 16.

Figure 4:
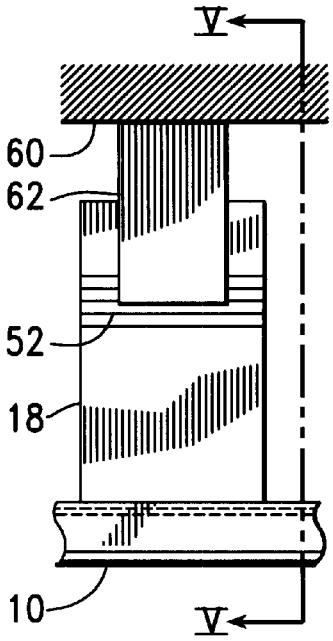
FIG. 4 is a fragmentary plan view of a valance mounted on a vertical wall surface in accordance a second embodiment of the invention.

FIG. 4 is a fragmentary plan view of the valance 10 mounted by a number of brackets 18 to a vertical wall surface 60 in accordance with a second embodiment of the invention. The valance 10 and the bracket 18 are built as described above in reference to FIGS. 1–3.

Figure 5:
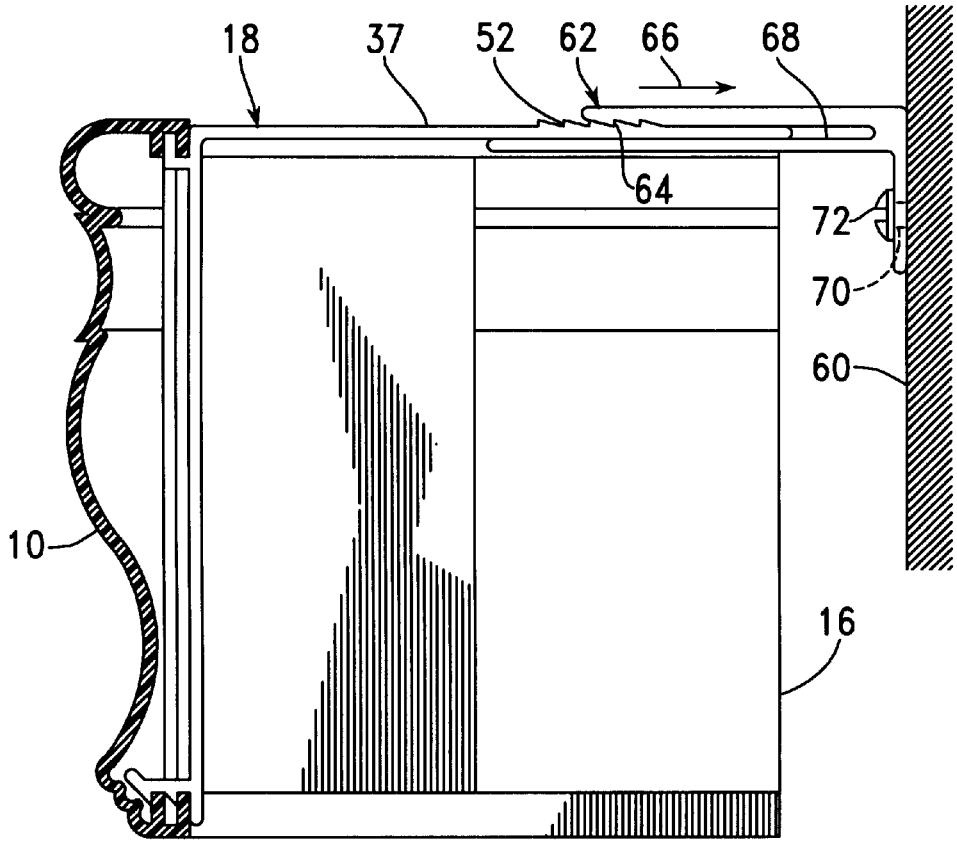
FIG. 5 is a transverse cross-sectional view of the valance and wall surface of FIG. 4, taken as indicated by section lines V—V therein.

FIG. 5 is a transverse cross-sectional view of the valance 10 and a bracket 18, mounted to the vertical wall surface 60 as shown in FIG. 4, taken as indicated by section line V—V in FIG. 4.

Referring to FIGS. 4 and 5, each bracket 18 is attached to the vertical wall surface 60 by means of a wall mounting bracket 62, including one or more latching surfaces 64 engaging a latching surface 52 of the attachment leg 37 of the bracket 18. Movement of the attachment leg 37 in the horizontal direction of arrow 66 in a slot 68 of the wall mounting bracket 62 provides for adjustment of a distance between the valance 10 and the vertical wall surface 60. Flexure within the wall mounting bracket 62, which is preferably composed of a thermoplastic resin, provides for the sequential engagement of the various latching surfaces 52, 64. The wall mounting bracket 62 also includes a hole 70, through which a screw or toggle bolt 72 extends to fasten the bracket 62 to the wall surface 60.

According to either embodiment of the invention, during or after the installation of the valance 10 to be held in place with a number of brackets 18, the adjustment features available through the multiple latching surfaces 52, providing for the movement of individual brackets 18 relative to the headrail 12 or the vertical wall surface 60 are used, together with the angular adjustment of each bracket 18 about the longitudinal axis 15 of the central elongated portion 14 by flexing this portion 14 so that either tooth 26, 28 is engaged within the lower slot 24, to straighten the central elongated portion 14, compensating for dimensional variations of various elements.

While two teeth 26, 28 have been described in reference to FIG. 3, it is understood that a larger number of teeth may be provided to establish a larger number of degrees of angular adjustment.

While the invention has been described in terms of its preferred embodiments with some degree of particularity, it is understood that this description has been given only as an example, and that numerous changes in the combination and arrangement of parts may be made without departing from the spirit and scope of the invention, as defined by the appended claims.

What is claimed is:

1. A mounting bracket for mounting a valance to an external structure, wherein said mounting bracket comprises:

a pivot for engaging a pivot receiving structure within said valance;

a plurality of latches for alternately engaging a latch receiving structure within said valance, wherein said plurality of latches are disposed in a first direction from one another and in a second direction, perpendicular to said first direction, from said pivot; and an attachment structure for attaching said mounting bracket to said external surface.

2. The mounting bracket of claim 1, wherein said attachment structure includes a spring clip for attaching said mounting bracket to a headrail.

3. The mounting bracket of claim 2, wherein said attachment structure additionally includes a mounting tab extending in a third direction and a plurality of latching surfaces disposed from one another in said third direction, and said spring clip includes a latching surface engaging tab alternately engaging latching surfaces in said plurality of latching surfaces as said spring clip is moved along said mounting tab in said third direction.

4. The mounting bracket of claim 1, wherein said attachment structure includes a wall mounting bracket for attaching said mounting bracket to a vertical wall surface.

5. The mounting bracket of claim 4, wherein said attachment structure additionally includes a mounting tab extending in a third direction and a plurality of latching surfaces disposed from one another in said third direction, and said wall mounting bracket includes a latching surface engaging tab alternately engaging latching surfaces in said plurality of latching surfaces as said wall mounting bracket is moved along said mounting tab in said third direction.

6. The mounting bracket of claim 1, wherein said attachment structure includes a mounting tab extending in a third direction and a plurality of latching surfaces disposed from one another in said third direction.

7. The mounting bracket of claim 1, wherein said pivot includes a tab extending away from said plurality of latches, and each latch in said plurality of latches includes a tooth extending away from said pivot.

8. The mounting bracket of claim 7, additionally comprising a flexible web extending between said pivot and said plurality of latches.

9. A valance assembly comprising an elongated valance member and a plurality of mounting brackets for mounting said elongated valance member to an external structure, wherein said mounting brackets in said plurality of mounting brackets are spaced apart along said elongated valance member, each mounting bracket in said plurality of mounting brackets includes an attachment structure for attaching said mounting bracket to said external surface;

said elongated valance member is mounted on each of said mounting brackets at a pivot point and at a latching point within a plurality of latching points, said elongated valance member is mountable on each of said mounting brackets at each latching point within said plurality of latching points while said elongated valance member is additionally mounted on said mounting bracket at said pivot point, said elongated valance member includes a pivot slot and a latching slot, and each mounting bracket in said plurality of mounting brackets includes a pivot tab extending into said pivot slot to form said pivot point and a plurality of teeth extending into said latching slot to form said plurality of latching points.

10. The valance assembly of claim 9, wherein said elongated valance member also includes a flexible web extending between said pivot slot and said latching slot, and each mounting bracket in said plurality of mounting brackets also includes a flexible web extending between said pivot tab and said plurality of teeth.

11. The valance assembly of claim 10, wherein open sides of said pivot slot and said latching slot extend toward one another;

said latching tab extends into said pivot slot in a first direction, and said teeth extend opposite said first direction.

12. The valance assembly of claim 11, additionally comprising a valance end member extending inward from each end of said elongated valance member, wherein adjacent surfaces of said valance end member and of said are mitered, and wherein each said end member a first slot aligned with said pivot slot and a second slot aligned with said latching slot, and an "L"-shaped bracket extending between said elongated valance member and each said valance end member, wherein said "L"-shaped bracket includes a first leg extending between said pivot slot and said latching slot of said elongated valance member and a second leg extending between said first and second slots of said valance end member.

13. A valance assembly comprising an elongated valance member and a plurality of mounting brackets for mounting said elongated valance member to an external structure, wherein said mounting brackets in said plurality of mounting brackets are spaced apart alone said elongated valance member, each mounting bracket in said plurality of mounting brackets includes an attachment structure for attaching said mounting bracket to said external surface;

said elongated valance member is mounted on each of said mounting brackets at a pivot point and at a latching point within a plurality of latching points, said elongated valance member is mountable on each of said mounting brackets at each latching point within said plurality of latching points while said elongated valance member is additionally mounted on said mounting bracket at said pivot point, each said attachment structure includes a spring clip for attaching said mounting bracket to a headrail, each said attachment structure additionally includes a mounting tab extending in a third direction and a plurality of latching surfaces disposed from one another in said third direction, and said spring clip includes a latching surface engaging tab alternately engaging latching surfaces in said plurality of latching surfaces as said spring clip is moved along said mounting tab in said third direction.

14. A valance assembly comprising an elongated valance member and a plurality of mounting brackets for mounting said elongated valance member to an external structure, wherein said mounting brackets in said plurality of mounting brackets are spaced apart along said elongated valance member, each mounting bracket in said plurality of mounting brackets includes an attachment structure for attaching said mounting bracket to said external surface;

said elongated valance member is mounted on each of said mounting brackets at a pivot point and at a latching point within a plurality of latching points, said elongated valance member is mountable on each of said mounting brackets at each latching point within said plurality of latching points while said elongated valance member is additionally mounted on said mounting bracket at said pivot point, each said attachment structure includes a wall mounting bracket for attaching said mounting bracket to a vertical wall surface, said attachment structure additionally includes a mounting tab extending in a third direction and a plurality of latching surfaces disposed from one another in said third direction, and said wall mounting bracket includes a latching surface engaging tab alternately engaging latching surfaces in said plurality of latching surfaces as said wall mounting bracket is moved along said mounting tab in said third direction.

* * * * *